US008651705B2

(12) United States Patent
Wilcox et al.

(10) Patent No.: US 8,651,705 B2
(45) Date of Patent: Feb. 18, 2014

(54) LED LIGHTING FIXTURE

(75) Inventors: Kurt S. Wilcox, Libertyville, IL (US); Wayne Guillien, Franksville, WI (US); Frank Tsao, Cleveland (AU)

(73) Assignee: Cree, Inc., Durham, NC (US)

( * ) Notice: Subject to any disclaimer, the term of this patent is extended or adjusted under 35 U.S.C. 154(b) by 209 days.

(21) Appl. No.: 12/876,826

(22) Filed: Sep. 7, 2010

(65) Prior Publication Data

US 2012/0057352 A1 Mar. 8, 2012

(51) Int. Cl.
*F21V 29/00* (2006.01)

(52) U.S. Cl.
USPC ..... 362/294; 362/373; 362/374; 362/375

(58) Field of Classification Search
USPC ..... 362/294, 373, 249.02, 362, 374, 375
See application file for complete search history.

(56) References Cited

U.S. PATENT DOCUMENTS

| | | | | |
|---|---|---|---|---|
| D399,581 | S | 10/1998 | Giese et al. | |
| D399,583 | S | 10/1998 | Giese et al. | |
| D399,584 | S | 10/1998 | Giese et al. | |
| D399,585 | S | 10/1998 | Giese et al. | |
| 5,988,833 | A | 11/1999 | Giese et al. | |
| 6,948,829 | B2 * | 9/2005 | Verdes et al. | 362/227 |
| 7,524,089 | B2 * | 4/2009 | Park | 362/294 |
| 2005/0174780 | A1 | 8/2005 | Park | |
| 2007/0253202 | A1 | 11/2007 | Wu et al. | |
| 2007/0279921 | A1 | 12/2007 | Alexander et al. | |
| 2008/0037255 | A1 | 2/2008 | Wang | |
| 2008/0080162 | A1 | 4/2008 | Wilcox et al. | |
| 2008/0106907 | A1 * | 5/2008 | Trott et al. | 362/368 |
| 2009/0086476 | A1 * | 4/2009 | Tickner et al. | 362/231 |
| 2009/0213595 | A1 * | 8/2009 | Alexander et al. | 362/373 |
| 2010/0328956 | A1 * | 12/2010 | Zhang | 362/294 |

OTHER PUBLICATIONS

Excerpts of e-conolight brochure. Date: May/Jun. 2010. 2 pages.

* cited by examiner

*Primary Examiner* — Thomas Sember
(74) *Attorney, Agent, or Firm* — Jansson Munger McKinley & Shape Ltd

(57) ABSTRACT

An LED lighting fixture comprising (a) a front-housing portion having a surrounding lateral wall defining a front cavity and extending to a front-housing forward edge at an open front-end, (b) a rear-housing portion having a backwall and a surrounding wall which define a rear cavity, the surrounding wall extending to a rear-housing forward edge, the rear-housing portion joined to the front-housing portion with the rear-housing surrounding wall substantially in alignment with the front-housing surrounding wall, (c) a cross-member secured with respect to the housing portions in a position at the juncture thereof and spanning the interior of the joined housing portions, the cross-member having a front surface facing the front cavity, and (d) an LED illuminator secured to the front surface of the cross-member.

24 Claims, 3 Drawing Sheets

LED LIGHTING FIXTURE

FIELD OF THE INVENTION

This invention relates to light fixtures. More particularly, this invention relates to light fixtures which utilize light-emitting diodes (LEDs) as the light source.

BACKGROUND OF THE INVENTION

In recent years, the use of LEDs for various common lighting purposes has increased, and this trend has accelerated as advances have been made in LEDs and in LED-array devices, often referred to as "LED modules." Indeed, lighting applications which have been served by fixtures using high-intensity discharge (HID) lamps and other light sources are now increasingly beginning to be served by LED fixtures. Creative work continues in the field of using LEDs for light fixtures in various applications.

High-luminance light fixtures using LEDs as the light source present particularly challenging problems. High cost due to high complexity becomes a particularly difficult problem when high luminance, reliability, and durability are essential to product success. Keeping electronic LED drivers in a water/air-tight location may also be problematic, particularly when the light fixtures are constantly exposed to the elements.

Dealing with heat dissipation requirements is still another problem area for high-luminance LED light fixtures. Heat dissipation is difficult in part because high-luminance LED light fixtures typically have many LEDs. Complex structures for module mounting and heat dissipation have sometimes been deemed necessary, and all of this adds complexity and cost.

Furthermore, previous fixtures utilizing HID lamps and other non-LED light sources typically require a comparatively large lamp compartment with large reflectors for lighting efficiency. Such fixtures often also require large ballast compartments. These often result in large overall fixture size and a substantially heavy fixture.

In short, there is a significant need in the lighting industry for improved light fixtures and the like using LEDs. There is a need for fixtures that satisfy the problems associated with heat dissipation and appropriate protection of electronic LED driver components. Finally, there is a need for an improved LED-module-based light which is relatively simple, compact and easy and inexpensive to manufacture.

OBJECTS OF THE INVENTION

It is an object of the invention to provide an improved LED lighting fixture that overcomes some of the problems and shortcomings of the prior art, including those referred to above.

Another object of the invention is to provide an improved LED lighting fixture that is readily adaptable for a variety of mounting positions and situations.

Another object of the invention is to provide an improved LED lighting fixture with both good protection of electronic LED drivers and excellent heat dissipation from LEDs and drivers.

Yet another object of the invention is to provide an improved LED lighting fixture providing desirable illumination.

Still another object of the invention is to provide an improved LED lighting fixture which is relatively simple and compact.

How these and other objects are accomplished will become apparent from the following descriptions and the drawings.

SUMMARY OF THE INVENTION

The present invention is an improvement in LED lighting fixtures. The inventive LED lighting fixture includes (a) front-housing portion having a surrounding lateral wall defining a front cavity and extending to a front-housing forward edge at an open front-end, (b) a rear-housing portion having a back-wall and a surrounding wall which define a rear cavity, the surrounding wall extending to a rear-housing forward edge, the rear-housing portion joined to the front-housing portion with the rear-housing surrounding wall substantially in alignment with the front-housing surrounding wall, (c) a cross-member secured with respect to the housing portions in a position at the juncture thereof and spanning the interior of the joined housing portions, the cross-member having a front surface facing the front cavity, and (d) an LED illuminator secured to the front surface of the cross-member.

In preferred embodiments of the inventive LED lighting fixture, the cross-member is a front-housing portion back-wall, and in some such embodiments, the rear-housing back-wall is integrally-formed with the rear-housing surrounding wall.

In highly-preferred embodiments, the cross-member is a heat sink which transfers heat from the LED illuminator to at least one of the joined housing portions, and it is preferred that the joined housing portions have heat-transfer contact with one another.

In some preferred embodiments, the outer surface of the front-housing portion includes a series of fins extending outwardly therefrom facilitating heat dissipation from the LED illuminator. In other preferred embodiments, the outer surface of the rear-housing portion includes a series of fins extending outwardly therefrom facilitating heat dissipation from the LED illuminator. And, in some highly-preferred embodiments, the outer surfaces of the front-housing and rear-housing portions each include a series of fins extending outwardly therefrom facilitating heat dissipation from the LED illuminator. In some such embodiments, the fins on the front-housing and rear-housing portions are aligned with one another.

In certain embodiments, the inventive LED lighting fixture includes an LED driver mounted within the rear cavity.

In certain preferred embodiments, the cross-member is substantially planar and the rear-housing portion surrounding wall includes a wire passage into the rear cavity.

The LED illuminator is preferably a multi-chip LED module. The module may be a type of LED package which includes twenty five LEDs compactly placed close together and coated by a layer of phosphorus selected to produce different colors of white light such as warm, neutral and cool white light. Such LED packages are highly energy-efficient and have a long operating life.

These packages are compact, high-flux-density light sources. The compact size of such multi-chip LED packages is also highly desirable. They are typically round or square with a diameter or a side length of about 20-26 millimeters and a depth of about 3.5 millimeters. The relatively small dimensions of these modules permit significant reduction in the dimensions of lighting fixtures which utilize such high-luminance compact LED light sources.

Some preferred embodiments of the inventive LED lighting fixture include a reflector defining an LED aperture exposing the LED illuminator.

Certain preferred embodiments include a cover sealingly connected to the front-housing portion, at least a portion of the cover being a light-transmissive lens member, and in some such embodiments, the cover is connected at the front-housing forward edge and further includes a gasket between the cover and the front-housing forward edge.

Some preferred embodiments of the inventive LED lighting fixture include (a) a front-housing portion having a hollow interior cavity defined by a front-housing backwall and a front-housing surrounding wall extending therefrom to a front-housing forward edge, the front-housing backwall having an interior side and an exterior side, (b) a rear-housing portion having a hollow interior cavity defined by a rear-housing backwall and a rear-housing surrounding wall extending therefrom forward to a rear-housing forward edge, the rear-housing portion removably attached to the front-housing portion with its rear-housing forward edge substantially in alignment with the perimeter of the exterior side of the front-housing backwall, and (c) an LED illuminator mounted on the interior side of the front-housing backwall.

It is preferred that both housing portions have a common central axis through the front and rear cavities, and that cross-sections of both housing portions perpendicular to the axis are substantially circular.

DETAILED DESCRIPTION OF PREFERRED EMBODIMENTS

Figure 1:
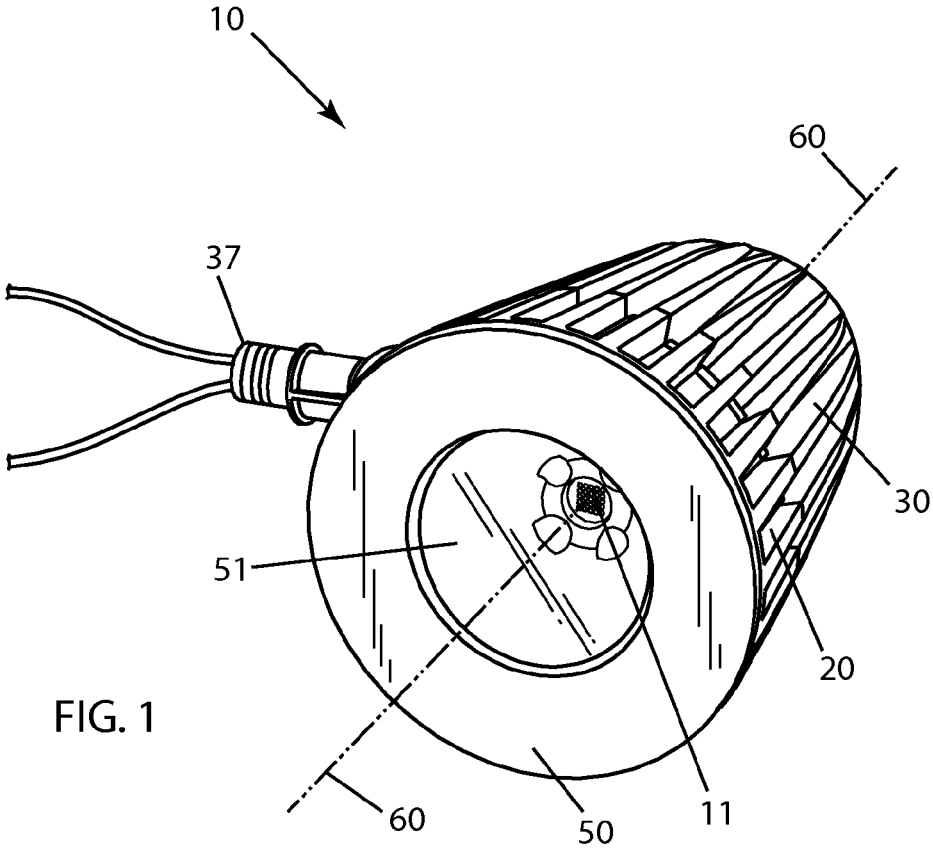
FIG. 1 is a front perspective view of a preferred embodiment of the LED lighting fixture in accordance with this invention.
Figure 2:
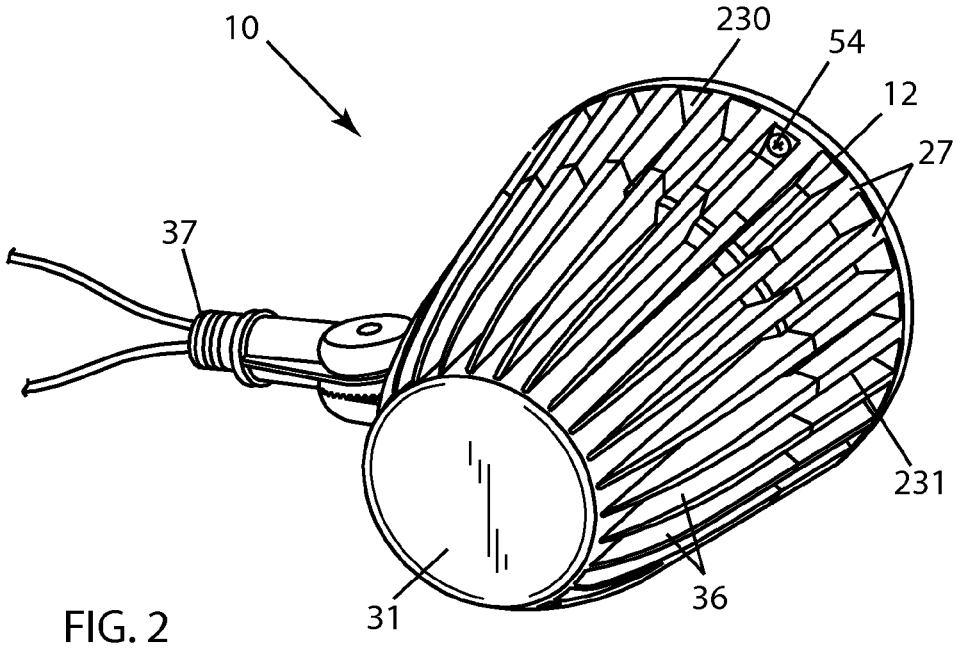
FIG. 2 is a rear perspective view of the lighting fixture of FIG. 1.
Figure 3:
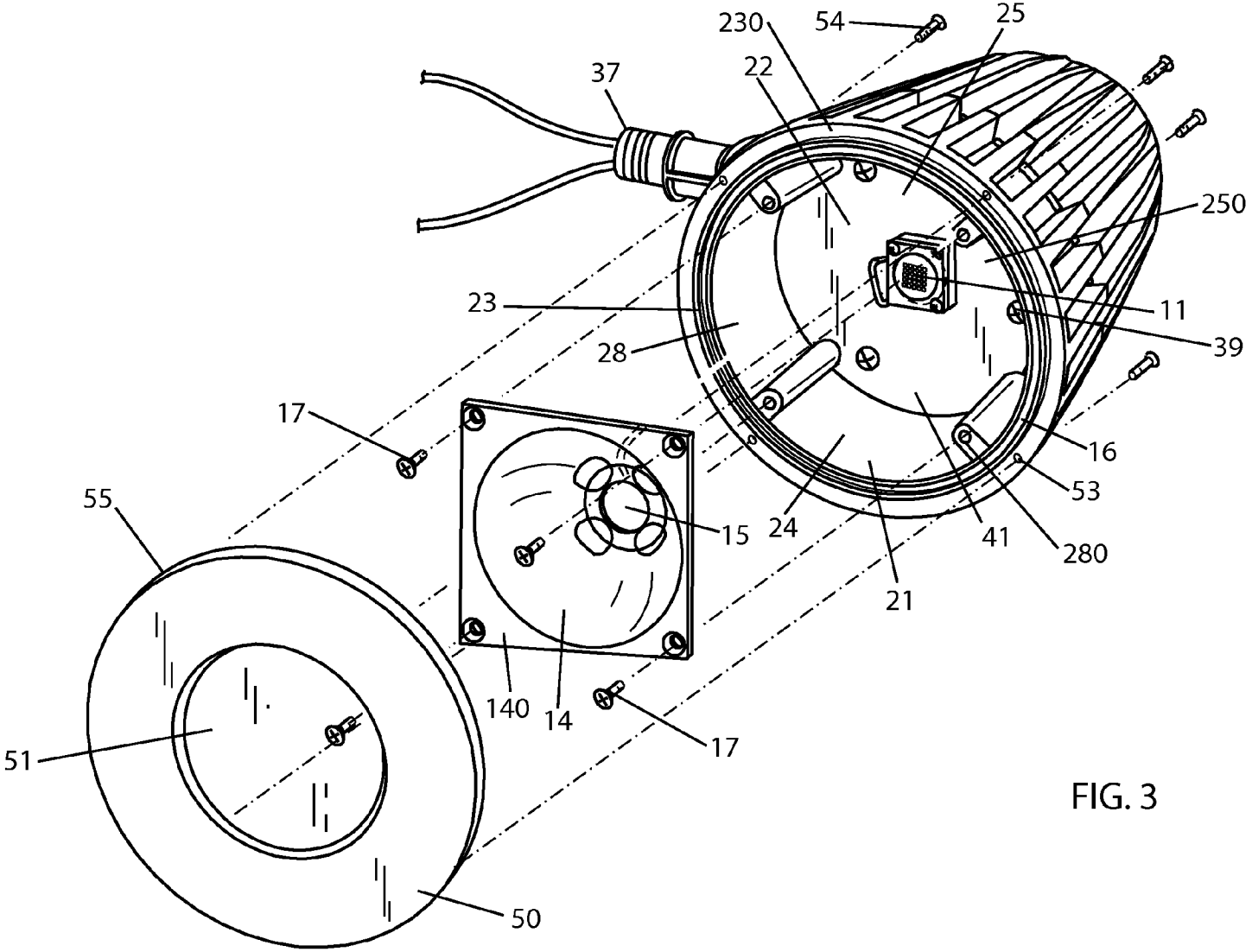
FIG. 3 is an exploded view of a front-housing portion of the lighting fixture of FIG. 1.

FIGS. 1-4 illustrate a preferred embodiment of an inventive LED lighting fixture 10. Lighting fixture 10 includes a front-housing portion 20 and a rear-housing portion 30. Front-housing portion 20 has a surrounding lateral wall 21 defining a front cavity 22 and extending to a front-housing forward edge 23 at an open front-end 24. Rear-housing portion 30 has a backwall 31 and a surrounding wall 32 which define a rear cavity 33. As best seen in FIG. 2, rear-housing backwall 31 is integrally-formed with rear-housing surrounding wall 32. Surrounding wall 32 extends to a rear-housing forward edge 34. Rear-housing portion 30 is joined to front-housing portion 20 with rear-housing surrounding wall 32 being substantially in alignment with front-housing surrounding wall 21. A cross-member 40 is secured with respect to housing portions 20 and 30 in a position at the juncture 12 thereof and spanning the interior of the joined housing portions 20 and 30. Cross-member 40 has a front surface 41 facing front cavity 22. An LED illuminator 11 is secured to front surface 41 of cross-member 40. LED illuminator 11 is a multi-chip LED module, as best seen in FIGS. 1 and 3.

Figure 4:
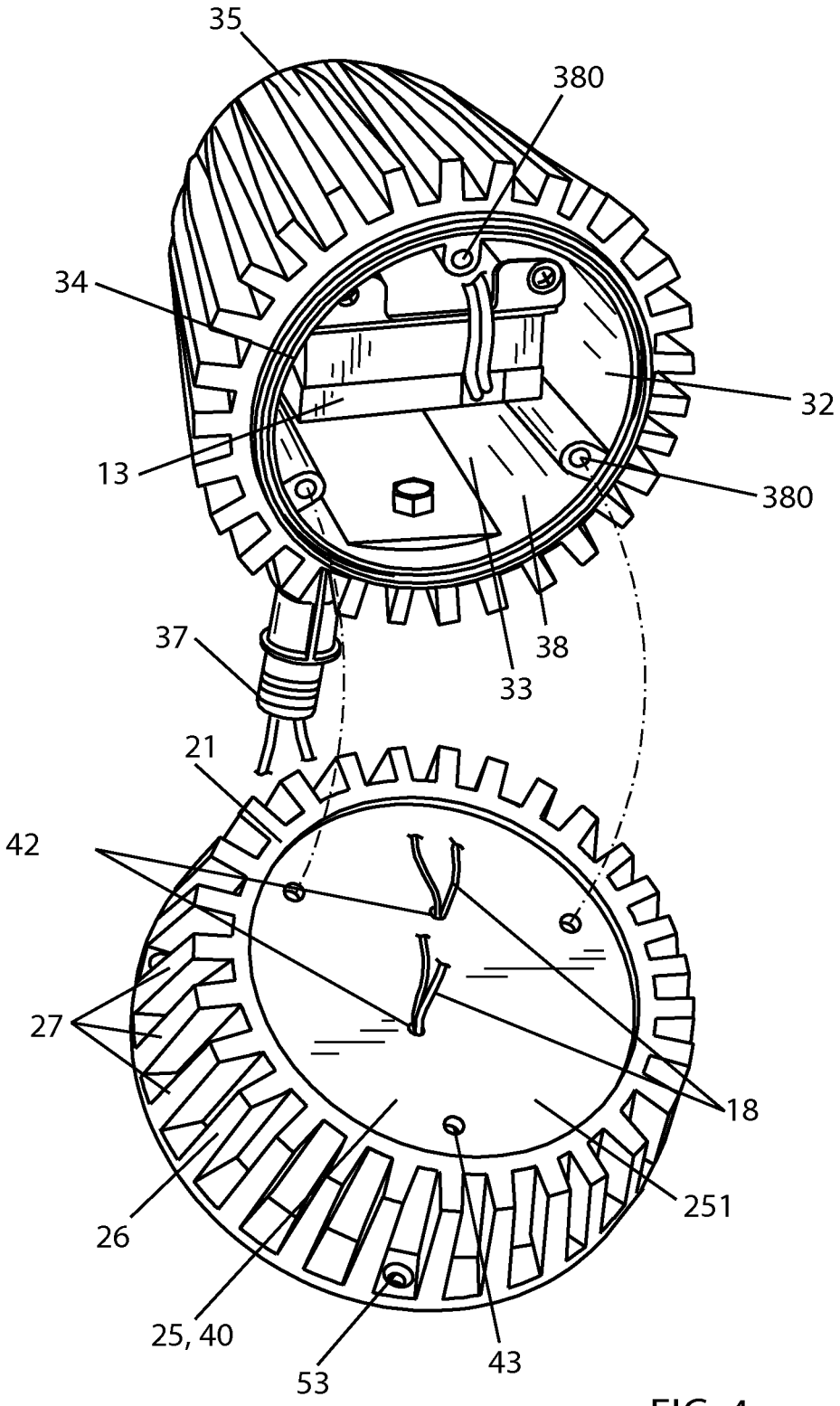
FIG. 4 is an exploded view of the lighting fixture of FIG. 1 showing front-housing and rear-housing portions being separated.

FIGS. 3 and 4 show that cross-member 40 is a front-housing portion backwall 25. Front-housing backwall 25 has an interior side 250 and an exterior side 251. LED illuminator 11 is secured to interior side 250.

Cross-member 40 is a heat sink transferring heat from LED illuminator 11 to at least one of joined housing portions 20 and 30. Joined housing portions 20 and 30 have heat-transfer contact with one another, as seen in FIGS. 1 and 2.

FIG. 4 illustrates that inner surface 38 of surrounding wall 32 of rear-housing portion 30 includes mounting channels 380 which are configured to receive fasteners 39 (see FIG. 3) extending through fastener apertures 43 defined by cross-member 40 to securely join housing portions 20 and 30.

FIG. 4 shows that LED lighting fixture 10 includes an LED driver 13 mounted within rear cavity 33.

Outer surface 26 of front-housing portion 20 includes a series of fins 27 extending outwardly therefrom facilitating heat dissipation from LED illuminator 11. Outer surface 35 of rear-housing portion 30 includes a series of fins 36 extending outwardly therefrom facilitating heat dissipation from LED driver 13 and further facilitating heat dissipation from LED illuminator 11. As seen in FIGS. 1-3, fins 27 and 36 on front-housing and rear-housing portions (20 and 30) are aligned with one another.

FIGS. 3 and 4 illustrate that cross-member 40 is substantially planar and defines wire passages 42 for passing wires 18 from rear-housing portion 30 to LED illuminator 11. It is further seen in the FIGURES that rear-housing portion surrounding wall 32 includes a wire passage 37 into rear cavity 33.

FIGS. 1 and 3 show that LED lighting fixture 10 includes a reflector 14 defining an LED aperture 15 exposing LED illuminator 11. As best seen in FIG. 3, reflector 14 is a reflector cup surrounding LED illuminator 11 for reflecting LED-emitted light in desired pattern and direction. Reflector cup 14 is so configured and positioned that its distal edges 140 are substantially at the level of forward edge 23 of front-housing portion surrounding wall 21. FIG. 3 further shows that inner surface 28 of surrounding wall 21 includes mounting channels 280 which are configured to receive fasteners 17 extending through distal edges 140 of reflector 14.

As is further seen in FIGS. 1 and 3, fixture 10 further includes a cover 50 sealingly connected to front-housing portion 20. A portion of cover 50 is a light-transmissive lens member 51 which may be made of glass or other suitable light-transmissive material. Cover 50 is connected at front-housing forward edge 23. Fixture 10 further includes a gasket 16 between cover 50 and front-housing forward edge 23. It is seen in FIGS. 2 and 3 that forward edge 23 of front-housing portion 20 includes an outward flange 230 which is sealingly engaged by cover 50 with gasket 16 therebetween. FIG. 3 further illustrates that outward flange 230 defines cover-mounting holes 53 which receive fasteners 54 extending therethrough from a rear side 231 of outward flange 230 to securely engage a rear side 55 of cover 50.

As shown in FIG. 1, front-housing portion 20 and rear-housing portion 30 have a common central axis 60 through front and rear cavities 22 and 33, and the cross-sections of housing portions of 20 and 30 perpendicular to axis 60 are substantially circular.

The invention claimed is:

1. An LED lighting fixture comprising:

a one-piece front-housing portion secured to a one-piece rear-housing portion, each housing portion having a respective backwall and a surrounding lateral wall which respectively define front and rear closed interior cavities, the backwall of the front-housing portion having a substantially-planar front surface facing the front cavity;

a reflector cup extending across the front-housing portion and defining a sole aperture therethrough; and an LED illuminator centrally-secured to the front surface of the backwall of the front-housing portion, the LED illuminator and the reflector cup being configured such that the LED illuminator is exposed through the reflector aperture while the majority of the front surface is behind the reflector cup, the backwall being a heat sink for transferring heat away from the LED illuminator during operation.

2. The LED lighting fixture of claim 1 wherein the rear-housing portion is joined to the front-housing portion such that the rear-housing surrounding wall is substantially in alignment with the front-housing surrounding wall.

3. The LED lighting fixture of claim 2 wherein the backwall of the front housing portion transfers heat from the LED illuminator to at least one of the joined housing portions.

4. The LED lighting fixture of claim 3 wherein the joined housing portions have heat-transfer contact with one another and have an uncovered outer surface facilitating dissipation of heat from the LED illuminator during operation.

5. The LED lighting fixture of claim 4 wherein the outer surface of the front-housing portion includes a series of fins extending outwardly therefrom facilitating heat dissipation from the LED illuminator.

6. The LED lighting fixture of claim 4 wherein the outer surface of the rear-housing portion includes a series of fins extending outwardly therefrom facilitating heat dissipation from the LED illuminator.

7. The LED lighting fixture of claim 6 wherein the outer surface of the front-housing includes a series of fins extending outwardly therefrom facilitating heat dissipation from the LED illuminator.

8. The LED lighting fixture of claim 7 wherein the fins on the front-housing and rear-housing portions are aligned with one another.

9. The LED lighting fixture of claim 1 including an LED driver within the rear cavity, the rear-housing portion surrounding wall having a wire passage into the rear cavity.

10. The LED lighting fixture of claim 1 wherein the LED illuminator is a multi-chip LED module.

11. The LED lighting fixture of claim 1 further including a cover connected to the front-housing portion, at least a portion of the cover being a light-transmissive lens member.

12. The LED lighting fixture of claim 11 wherein:

the surrounding lateral wall of the front-housing portion extends to a front-housing forward edge at an open front-end;

the cover is connected at the front-housing forward edge; and a gasket is between the cover and the front-housing forward edge.

13. The LED lighting fixture of claim 1 wherein:

both housing portions have a common central axis through the front and rear cavities; and cross-sections of both housing portions perpendicular to the axis are substantially circular.

14. An LED lighting fixture comprising:

a one-piece front-housing portion and a one-piece rear-housing portion removably attached to the front-housing portion, each housing portion having a hollow closed interior cavity defined by a respective backwall and a respective surrounding wall extending therefrom to a respective forward edge, the front-housing backwall having a substantially planar interior surface and an exterior surface, the rear-housing forward edge being substantially in alignment with the perimeter of the exterior side of the front-housing backwall;

a reflector cup extending across the front-housing portion and defining a sole aperture therethrough; and an LED illuminator centrally-mounted on the interior surface of the front-housing backwall, the LED illuminator and the reflector cup being configured such that the LED illuminator is exposed through the reflector aperture while the majority of the interior surface is behind the reflector cup, the backwall being a heat sink for transferring heat away from the LED illuminator during operation.

15. The LED lighting fixture of claim 14 wherein the housing portions have an uncovered outer surface, the outer surface of the front-housing portion including a series of fins extending outwardly therefrom facilitating heat dissipation from the LED illuminator.

16. The LED lighting fixture of claim 14 wherein the housing portions have an open outer surface, the outer surface of the rear-housing portion including a series of fins extending outwardly therefrom facilitating heat dissipation from the LED illuminator.

17. The LED lighting fixture of claim 16 wherein the outer surface of the front-housing includes a series of fins extending outwardly therefrom facilitating heat dissipation from the LED illuminator.

18. The LED lighting fixture of claim 17 wherein the fins on the front-housing and rear-housing portions are aligned with one another.

19. The LED lighting fixture of claim 14 including an LED driver within the rear cavity, the rear-housing portion wall having a wire passage into the rear cavity.

20. The LED lighting fixture of claim 14 wherein the front-housing backwall is substantially planar.

21. The LED lighting fixture of claim 14 wherein the LED illuminator is a multi-chip LED module.

22. The LED lighting fixture of claim 14 further including a cover connected to the front-housing portion, at least a portion of the cover being a light-transmissive lens member.

23. The LED lighting fixture of claim 22 wherein:

the surrounding lateral wall of the front-housing portion extends to a front-housing forward edge at an open front-end;

the cover is connected at the front-housing forward edge, and a gasket is between the cover and the front-housing forward edge.

24. The LED lighting fixture of claim 14 wherein:

both housing portions have a common central axis through the front and rear cavities; and cross-sections of both housing portions perpendicular to the axis are substantially circular.

* * * * *